US008742304B2

(12) United States Patent
Emma

(10) Patent No.: US 8,742,304 B2
(45) Date of Patent: Jun. 3, 2014

(54) MULTIPLE LINKED APPLIANCES WITH AUXILIARY OUTLET

(75) Inventor: Phillip Emma, Topsfield, MA (US)

(73) Assignee: Intirion Corporation, Walpole, MA (US)

( * ) Notice: Subject to any disclaimer, the term of this patent is extended or adjusted under 35 U.S.C. 154(b) by 1474 days.

(21) Appl. No.: 12/317,632

(22) Filed: Dec. 23, 2008

(65) Prior Publication Data

US 2009/0188911 A1 Jul. 30, 2009

Related U.S. Application Data

(60) Provisional application No. 61/009,419, filed on Dec. 28, 2007.

(51) Int. Cl.
*H05B 6/64* (2006.01)
*H05B 6/68* (2006.01)

(52) U.S. Cl.
USPC ..... 219/679; 219/717; 219/720

(58) Field of Classification Search
USPC ..... 219/679, 482, 483, 485, 695, 697, 702, 219/717, 720, 715, 678
See application file for complete search history.

(56) References Cited

U.S. PATENT DOCUMENTS

| | | | | |
|---|---|---|---|---|
| 4,763,015 | A | 8/1988 | St. Louis | |
| 4,847,722 | A | 7/1989 | Bennett | |
| 4,880,954 | A | 11/1989 | Bennett et al. | |
| 5,521,359 | A * | 5/1996 | Bone | 219/679 |
| 2003/0075538 | A1 * | 4/2003 | Kish et al. | 219/506 |
| 2007/0086126 | A1 * | 4/2007 | Baxter | 361/42 |
| 2007/0262646 | A1 * | 11/2007 | Lee | 307/39 |

FOREIGN PATENT DOCUMENTS

JP 2001-33043 A * 2/2001

OTHER PUBLICATIONS

English translation Furukawa (JP2001-33043); Feb. 2001.*
Abstract Translation Furukawa et al. (JP2001-33043); Feb. 2001.*

* cited by examiner

*Primary Examiner* — Henry Yuen
*Assistant Examiner* — Hung D Nguyen
(74) *Attorney, Agent, or Firm* — Brett A. Schenck; Walker & Jocke

(57) ABSTRACT

A combination microwave and refrigerator system is constructed having a single plug input supply. The microwave oven is adapted to provide power to a refrigerator, and to auxiliary receptacles adapted for low power operation. The current to the low power receptacles and the refrigerator is controlled by the controller for the microwave oven according to the duty cycles of the connected appliances to avoid overload conditions.

31 Claims, 10 Drawing Sheets

MULTIPLE LINKED APPLIANCES WITH AUXILIARY OUTLET

RELATED APPLICATIONS

This application claims priority from Provisional Application for Patent No. 61/009,419, filed Dec. 28, 2007.

FIELD OF THE INVENTION

This application relates to a system of multiple linked appliances connected to a power supply through a single supply cord. In particular a refrigerator and microwave are connected for single plug operation while providing additional special purpose outlets.

BRIEF DESCRIPTION OF RELATED DEVELOPMENTS

Combination refrigerator and microwave oven systems are described in U.S. Pat. Nos. 4,880,954 and 4,847,722. In the devices described, the refrigerator is connected to the power supply and provides a connection for the microwave oven to be connected to the same supply. A single plug, therefore, serves to connect both appliances and the current required for each appliances is supplied by the same supply cord and circuit.

To make this combination attractive for use in dorm rooms, hotel rooms, recreational vehicles, tractor trailer cabs, and other similar locations, it is necessary to provide some means by which the peak currents of both appliances are not demanded from the supply at the same time. Many household circuits are protected from overload conditions by means of an automatic circuit breaker that is activated when current in the circuit exceeds the breaker rating. This is 15 amps in many circuits.

The duty cycle of a refrigerator used in these combined systems includes a current spike that occurs during the first few seconds of operation. This is the start up current for the refrigerator compressor and is considerably reduced, as the compressor obtains its operational speed. In typical refrigerator appliances the peak current may be in the range of 7 to 9 amps, while the steady state current may level off at 1.4 amps or less. A microwave oven demands a relatively steady 8 to 13 amps. It is apparent that an overload condition will occur frequently, when both appliances are in use, unless some control is exercised.

In the '954 patent the compressor power is disabled when the microwave is energized. This is accomplished by coupling the timer of the microwave to the compressor power. In addition a door interlock enables the compressor, since the microwave is disabled when the door is open. The '722 patent describes a control circuit for a combination microwave and refrigerator system in which a relay disables the microwave oven for a period of time depending on the rating of the compressor, when the compressor of the refrigerator is energized.

It would be advantageous to construct a combination microwave/refrigerator system, that also provides auxiliary outlets for low power applications, such as for the purpose of recharging cellular phones, operating lap top computers and other low power devices, while controlling the operation of the appliances to avoid overload conditions.

SUMMARY OF THE INVENTION

In an embodiment of this invention, a combination microwave and refrigerator system is constructed having a single plug input supply. The microwave oven is adapted to provide power to a refrigerator, and to auxiliary receptacles adapted for low power operation. The microwave oven includes a microprocessor controller adapted to monitor operation of the refrigerator compressor and controls the power to the microwave magnetron and other components. The current to the low power receptacles are separately monitored for control by the microwave controller. The microwave controller is adapted to balance the duty cycles of the connected appliances attached to avoid overload conditions. A control algorithm is implemented internally within the microwave controller. A receptacle for the refrigerator and the low power auxiliary receptacle may be implemented as part of the microwave control panel.

In one embodiment, the auxiliary outlets are constructed to provide low power for the purpose of recharging cellular phones, personal media devices, digital cameras, in addition to operating lap top computers and other low power devices. The current to the auxiliary outlets is sensed and provided to the microwave controller.

In another embodiment, the power to the auxiliary outlets is disabled by the microwave controller when the microwave magnetron is energized or whenever the current to the auxiliary outlets exceeds a preset value.

In one embodiment, a control model is established and executed by the microwave controller. The model is dependent on the state of operation of the microwave magnetron. As part of the control model, the power to the compressor is monitored to sense operation of the compressor. When power to the microwave is demanded, the compressor is disabled for a preset minimum period. When microwave demand ceases, refrigerator power is restored provided, that the preset minimum period has expired.

In another embodiment of the control module, sensing circuits are connected to monitor current to the auxiliary outlets. The control model is adapted to disable the power to the auxiliary receptacles, if the microwave is in operation. In addition the auxiliary receptacles are disabled if a predetermined maximum current is sensed. Another control model is based on operation of the refrigerator and operates to disable the auxiliary receptacles when the compressor is in the start up mode In one aspect of the invention, a non-transitory processor storage readable medium having processor readable program code embodied therein for operating a control processor to control a system of multiple linked appliances having a microwave oven, a refrigerator, and a auxiliary power supply outlet is provided. The processor readable program code causes the control processor to disable the refrigerator and the auxiliary power supply outlet, when the microwave demands power, and enable the auxiliary power supply outlet when the microwave is off.

BRIEF DESCRIPTION OF THE DRAWINGS

The system of this invention is explained in more detail below with reference to the accompanying drawing, in which.

DESCRIPTION OF THE PREFERRED EMBODIMENT

Figure 1:
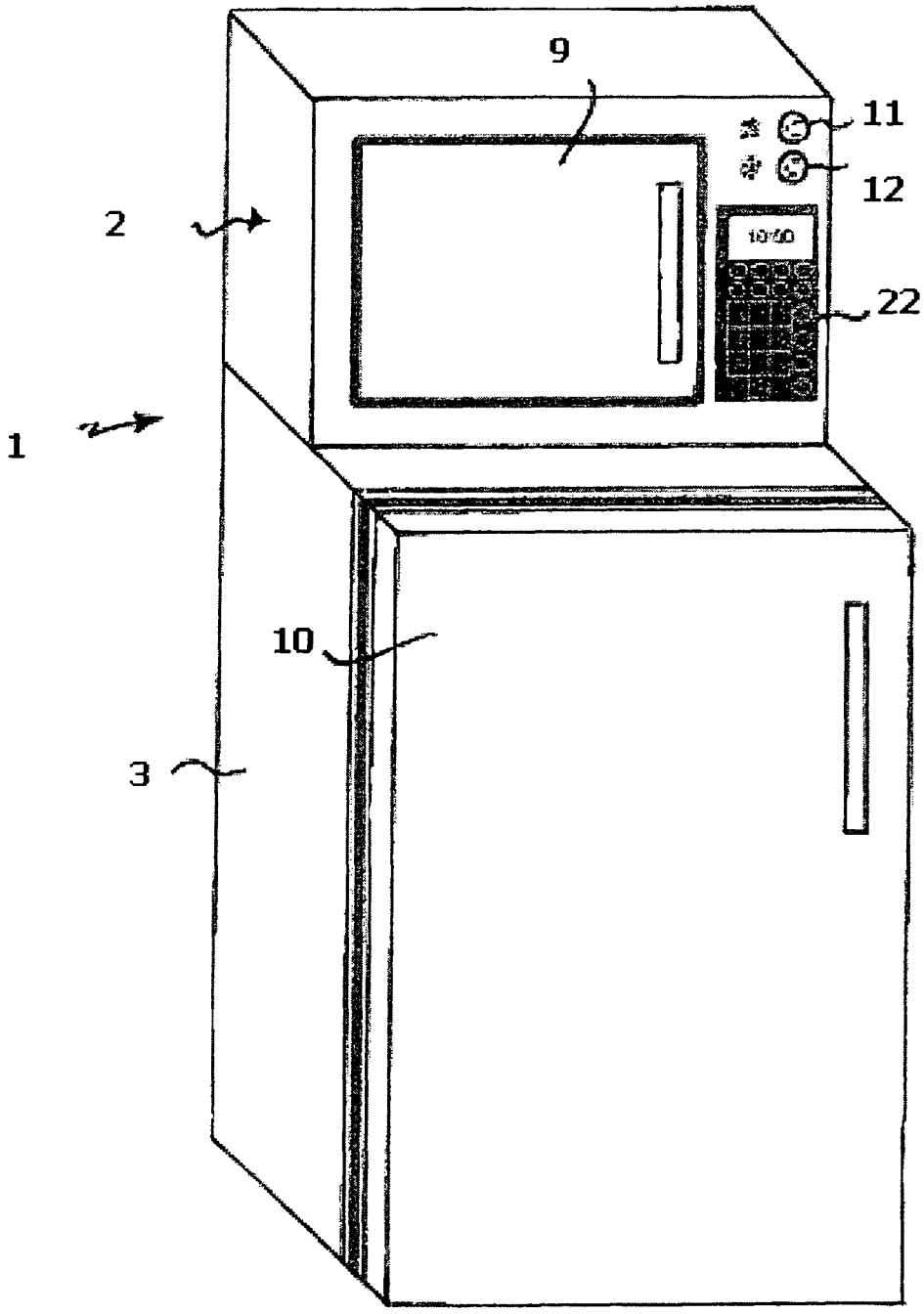
FIG. 1 is a front perspective view of an embodiment of an appliance system of this application.

A multiple linked appliance system 1, for example, a combination microwave oven 2, a refrigerator 3 incorporating features of the present invention is illustrated in the figures. Although the present invention will be described with reference to the embodiments shown in the drawings, it should be understood that the present invention may have many alternate forms. In addition, any suitable size, shape or type of elements or materials could be used. The computer operated devices described in this application may be constructed having one or several processors and one or several program product modules stored in one or several memory elements. For illustration, computer components may be described as individual units by function. It should be understood, that in some instances, these functional components may be combined.

Figure 2:
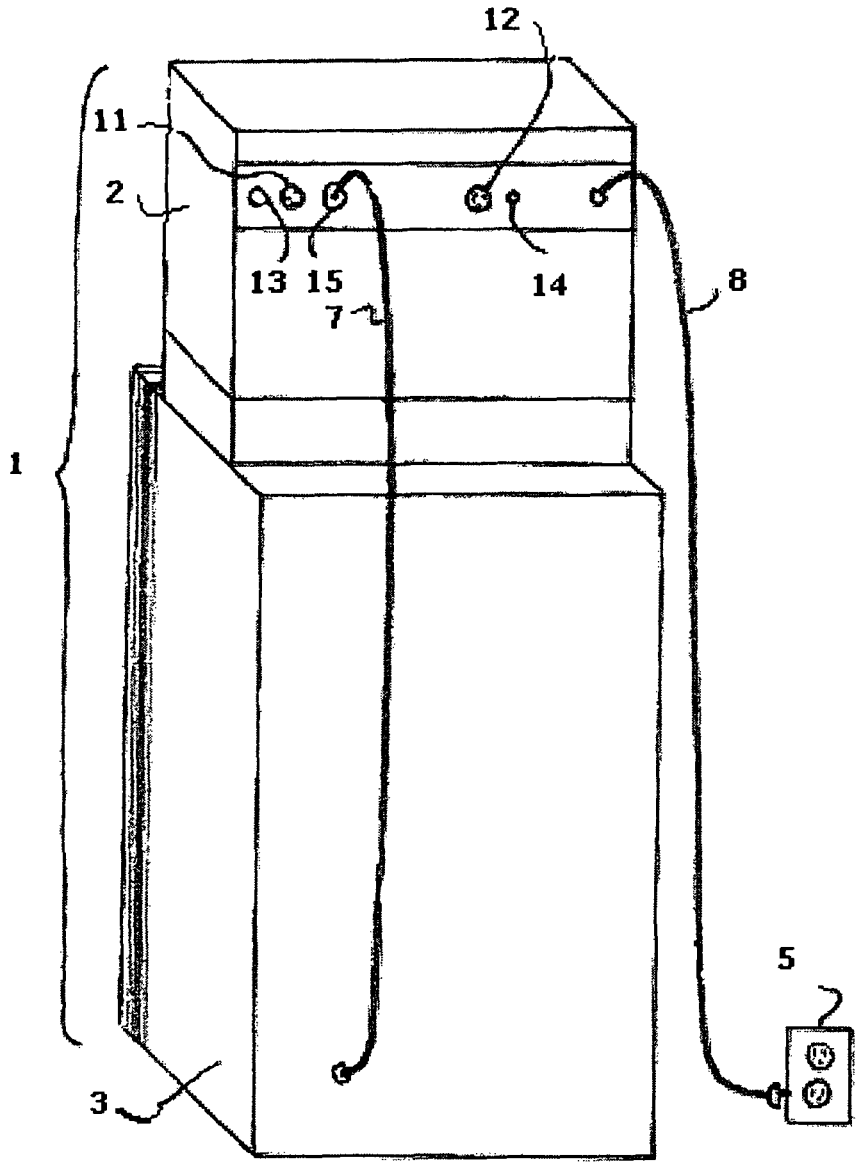
FIG. 2 is a rear perspective view of the embodiment of FIG. 1 showing an alternative arrangement.

One embodiment of a multi-appliance interconnected system 1 is illustrated in FIG. 1. This embodiment consists of two stand alone appliances, a refrigerator 3 and a microwave oven 2. Refrigerator 3 is connected to microwave oven 2 by power cord 7 to refrigerator receptacle 15, shown at the rear of the microwave 2 in FIG. 2. Refrigerator 3 is generally subject to control by the microwave microprocessor controller 4 of the microwave oven 2. A single cord 8, provides input power to the system 1 from receptacle 5 through microwave 2. In the case where stand alone appliances are used, as shown in FIGS. 1 and 2, microwave oven 2 is connected directly to power source 5. The refrigerator 3, as the heaviest component, is used as the base with the microwave oven 2 stacked on top. In the selection of the refrigerator 3, it would be advantageous in one embodiment for the height of the refrigerator to be no more than 48 inches above the floor. This provides a more ergonomic operation of the microwave oven 2 for the user. In addition, in the stacked position of the appliances in an embodiment, the doors 9 and 10 of the microwave 2 and refrigerator 3, respectively, should be arranged in a common plane. The appliances may be of standard design with features commonly available. The internal components of the appliances are well known and do not need to be described herein.

Figure 3:
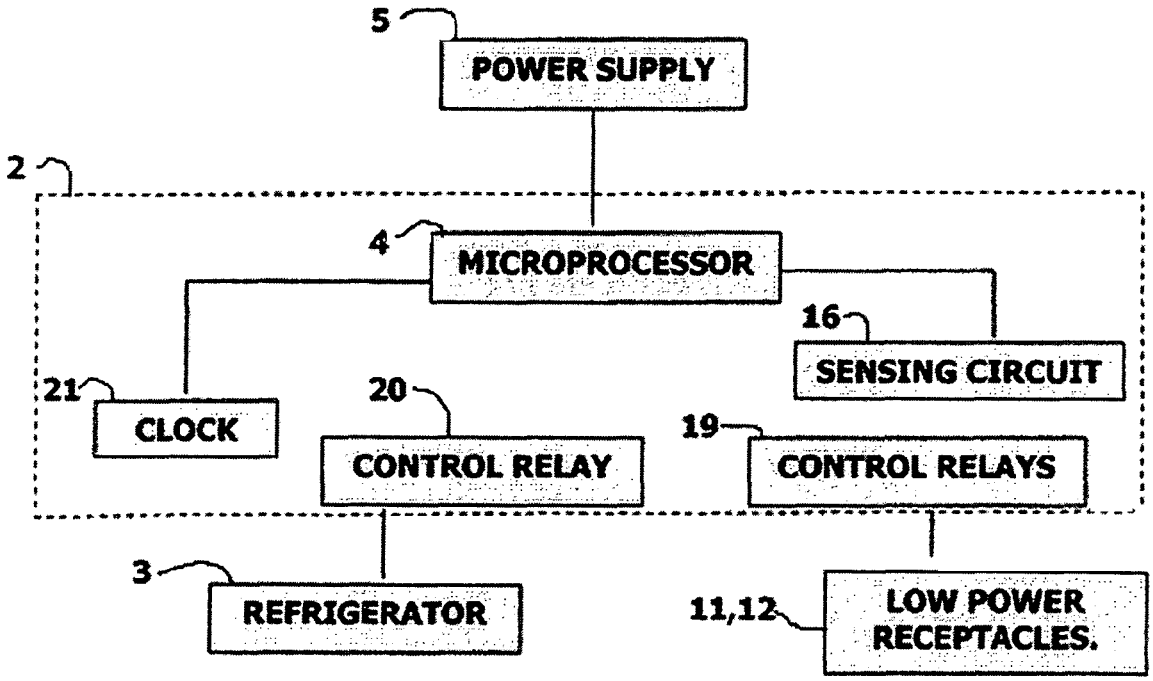
FIG. 3 is a block diagram of an embodiment of the system of this application.
Figure 8:
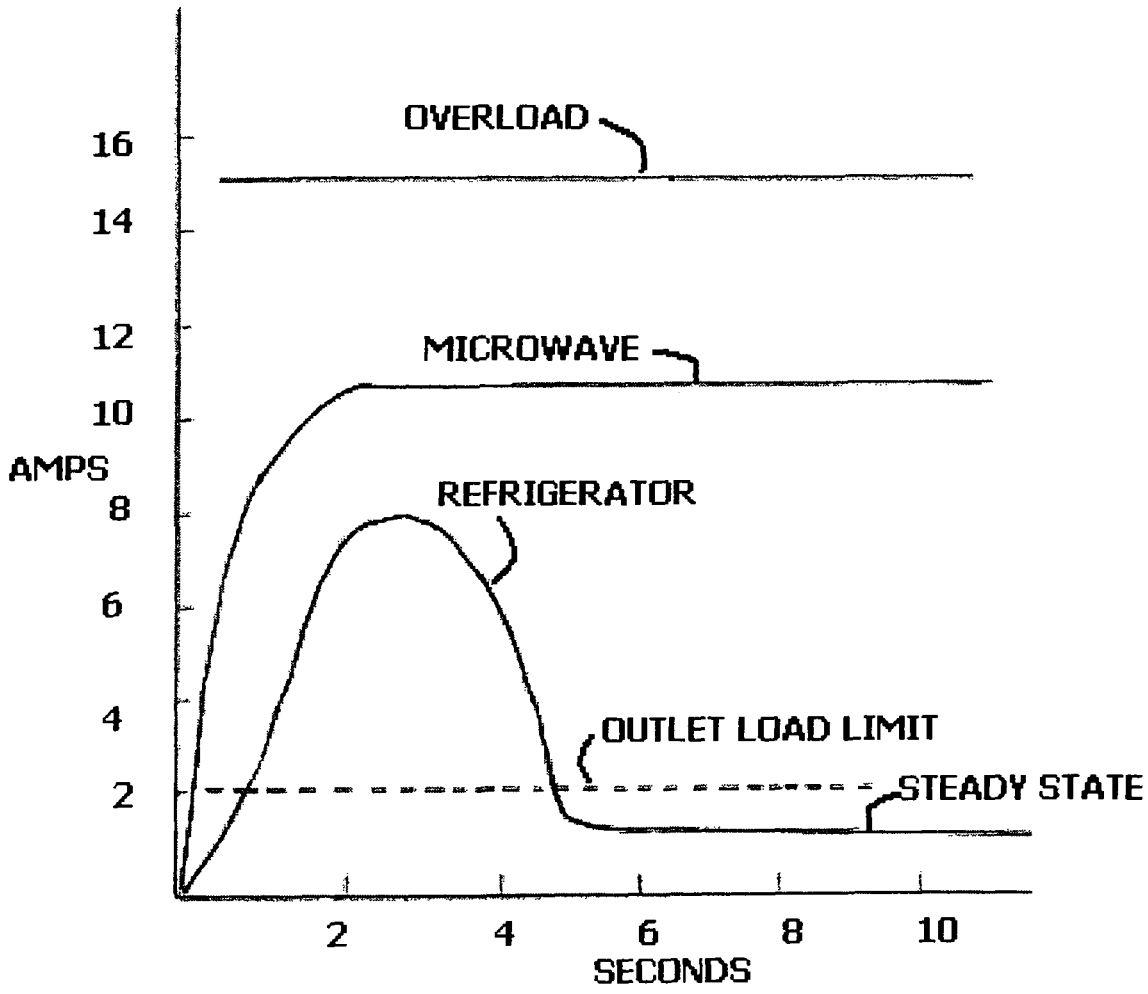
FIG. 8 is a graph illustrating the duty cycles of the appliances in the system of FIG. 3.

Microprocessor 4 is the controller for the operation of the microwave oven 2 and is also adapted to control the other components of system 1, as shown in FIG. 3. Power is distributed throughout the system 1 under control of microwave controller 4 and digitally operated switches such as relays 19 and 20 of FIG. 3. Power is distributed to each of the appliances 2 and 3, and to auxiliary low power receptacles 11 and 12. In use lamps 13 and 14 in the form of LED'S or the like may be connected to the auxiliary receptacles to indicate power being available or disabled. The low power auxiliary receptacles 11 and 12 are provided to permit convenient access for plugging in a low power device for example, rechargeable devices, such as cellular phones, PDA's, or other electronic devices that do not demand high power. As shown in the graph of FIG. 8, there are instances during which, if more than one of the appliances is in use, the cumulative current would cause an overload condition.

Control panel 22 of microwave oven 2 may be adapted to provide a display of the particular status of the controlling relays, for example, LED's 13 and 14 may indicate that power to the outlets 11, and 12 are disabled or available. In one embodiment the lamps will light when power is available at the outlet and flash when disabled. A button operated touch panel provides manual control.

Figure 4:
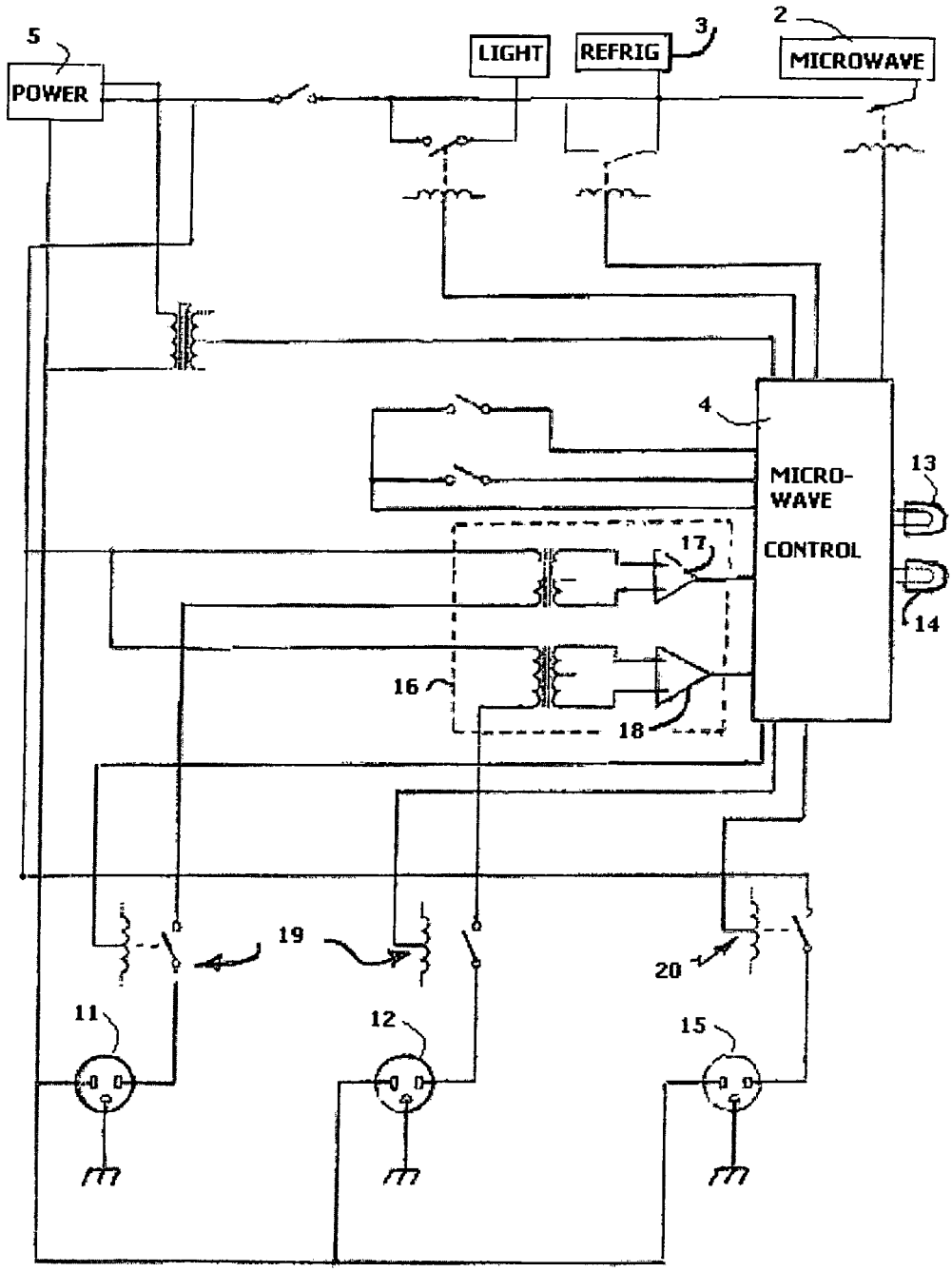
FIG. 4 is a schematic diagram of the embodiment of FIG. 3.

As shown in FIG. 4, in order to control the power to the microwave 2, refrigerator 3 and receptacles 11 and 12, sensing circuits, may be coupled to the controller to monitor current to the appliances and the auxiliary receptacles. A relay 20 is connected in the power line to the refrigerator and may be actuated by signals from controller 4. In particular, according to an embodiment of this application, sensing circuits 16, as shown in FIG. 4, have sensors 17 and 18 coupled to the power line of the auxiliary outlets 11 and 12 to monitor the current being used by a connected device. Sensors 17 and 18 may be current sensing transformers of the type available from Triad Magnetics of Corona, Calif. The signals generated by sensors 17 and 18 may be used to activate switches or other control components, such as relays 19. Relays 19 may be actuated by controller 4 to enable and disable power to the low power auxiliary outlets 11 and 12 in response to signals from sensors 17 and 18. A maximum current may be set by controller 4 to prevent overload of the outlets 11 and 12. In one embodiment of the system of this application, the maximum current limit is set at 2 amps.

In another embodiment, a clock device 21 could be used to provide timed delays during which, for example, refrigerator 3 would be prevented from undesirably rapid on/off cycles. When refrigerator 3 is disabled during microwave operation, a time delay of 3 minutes is provided during which refrigerator 3 will remain disabled, even if microwave use is only for a short period. Controller 4 may be programmed to manage the power to the components of the system to avoid overload conditions, while minimizing disruptions in the use of an individual appliance. A model of operative events and related control operations may be designed into the program executed by controller 4 to provide a control methodology as illustrated in FIGS. 5-7.

In one embodiment, as illustrated in the block diagram of FIG. 3, microprocessor controller 4, constructed as part of the controller for microwave 2, would be adapted to process the sensor signals and identify particular events in the system 1 related to a particular appliance. Microprocessor 4 would control the power to microwave 2 and refrigerator 3 and also low power receptacles 11 and 12 to avoid overload conditions. The microprocessor 4 could be programmed to execute the control methods illustrated and described below. In a preferred embodiment, the controller 4 is the control microprocessor for microwave oven 2 and is adapted to execute the control algorithms described below. Controller 4 is coupled directly to refrigerator outlet 15 and low power outlets 11 and 12.

In one embodiment, shown in FIG. 1, the outlets 11, and 12, are installed as part of the front control panel of microwave oven 2. In FIG. 2, in another embodiment, the auxiliary receptacles 11 and 12 and refrigerator receptacle 15 are accessible at the rear of the microwave oven 2. In these alternative embodiments, the microwave oven 2 is connected by supply cord 8 directly to power supply receptacle 5. Refrigerator 3 is connected by power cord 7 to receptacle 15 in microwave oven 2 as shown in FIG. 2.

Figure 5:
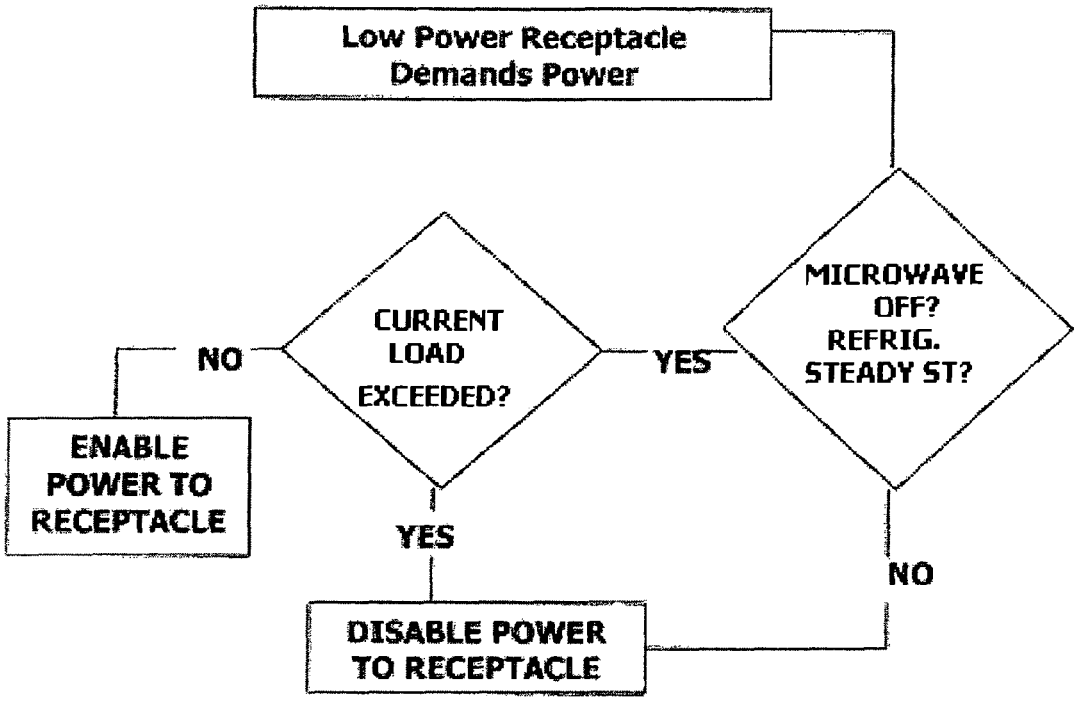
FIG. 5 is a flow diagram of an embodiment of this application.
Figure 6:
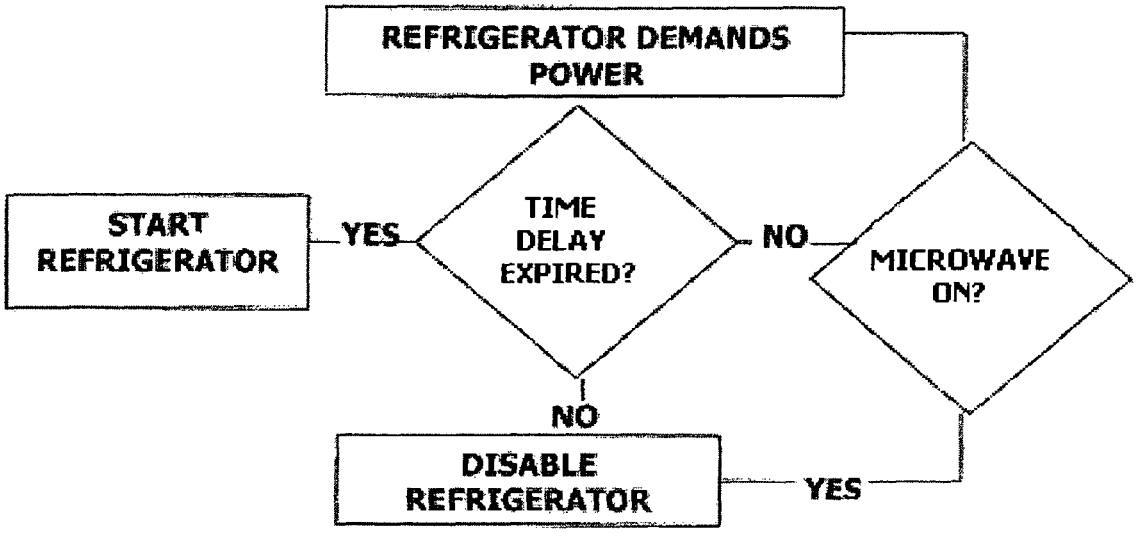
FIG. 6 is a flow diagram of another embodiment of this application.
Figure 7:
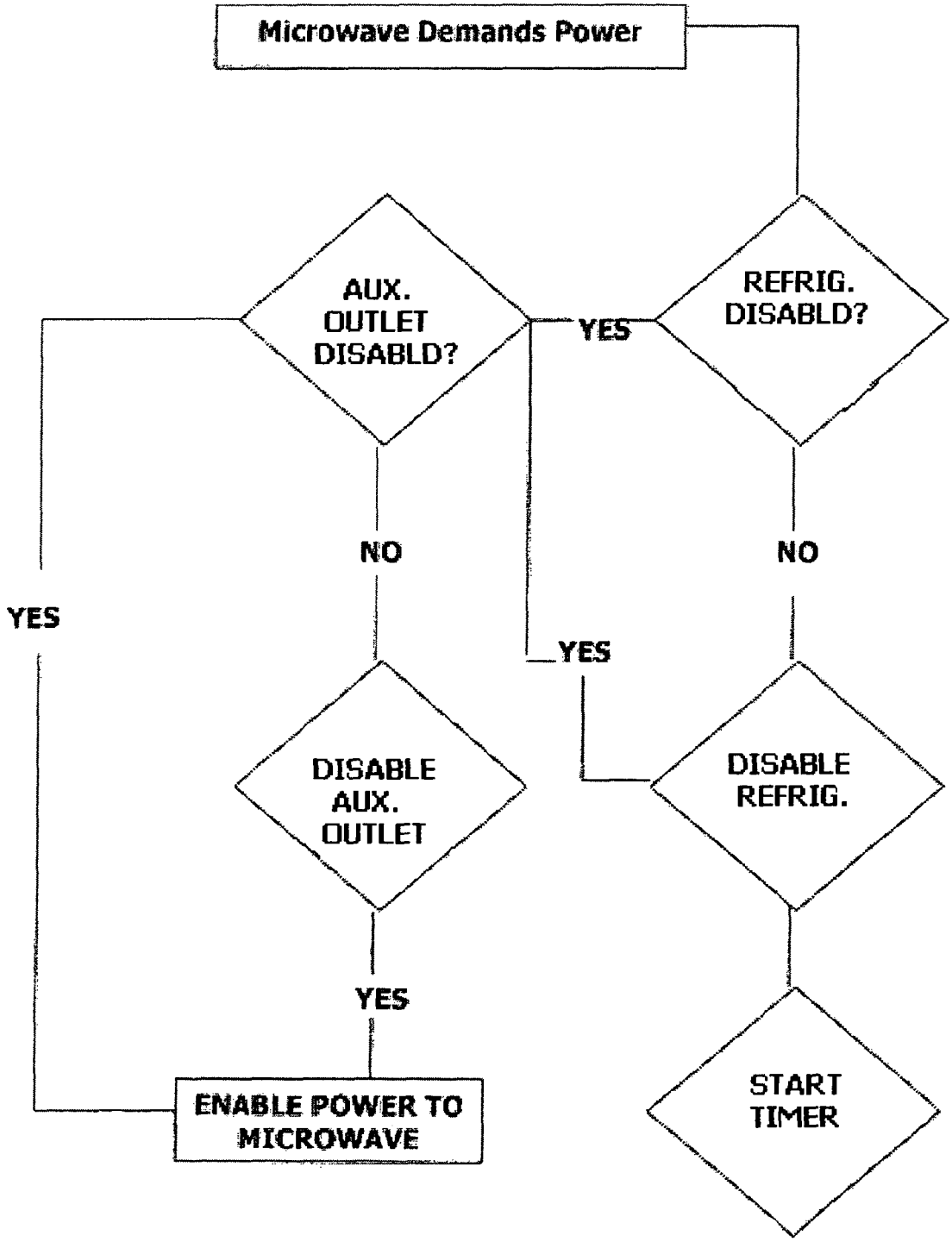
FIG. 7 is a flow diagram of another embodiment of this application.

In one embodiment, control models are established as shown in FIGS. 5-7 for execution by the controller 4. These models can be in the form of algorithms stored in a computer readable medium, such as software or firmware within microprocessor 4. The models shown are, in the first instance, dependent on the state of operation of microwave oven 2. The current demands of the microwave 2 are generally the most significant contribution to overload, as shown in FIG. 8. To avoid overload conditions, power to the low power receptacles 11 and 12 and refrigerator receptacle 15 is disabled during microwave operation. If the refrigerator 3 is under power when the microwave 2 is turned on, the power, to the refrigerator is turned off and clock 21 begins to count for a predetermined period during which the compressor of refrigerator 3 cannot be restarted. A time delay, for example, of 3 minutes, may be set and when this delay period is expired, receptacle 15 may again be enabled, providing microwave operation has ceased. This prevents a too rapid restart of the compressor that may otherwise result in damage.

In the embodiment shown in FIG. 5, if low power is demanded at receptacle 11 or 12 and microwave oven 2 is not in use, power is supplied to the low power receptacles, providing further, that the current demand in an individual outlet does not exceed a preset limit, for example, 2 amps. Since the auxiliary outlets may be enabled during refrigerator operation, there may be an overload generated at peak compressor operation. In one embodiment the microwave controller acts to disable the auxiliary outlets during compressor startup to prevent accidental overload of the system. Therefore as illustrated in the flow diagram of FIG. 5, controller may be adapted to check the operational status of the refrigerator, as well as the microwave oven, prior to enabling the auxiliary outlets.

Figure 9:
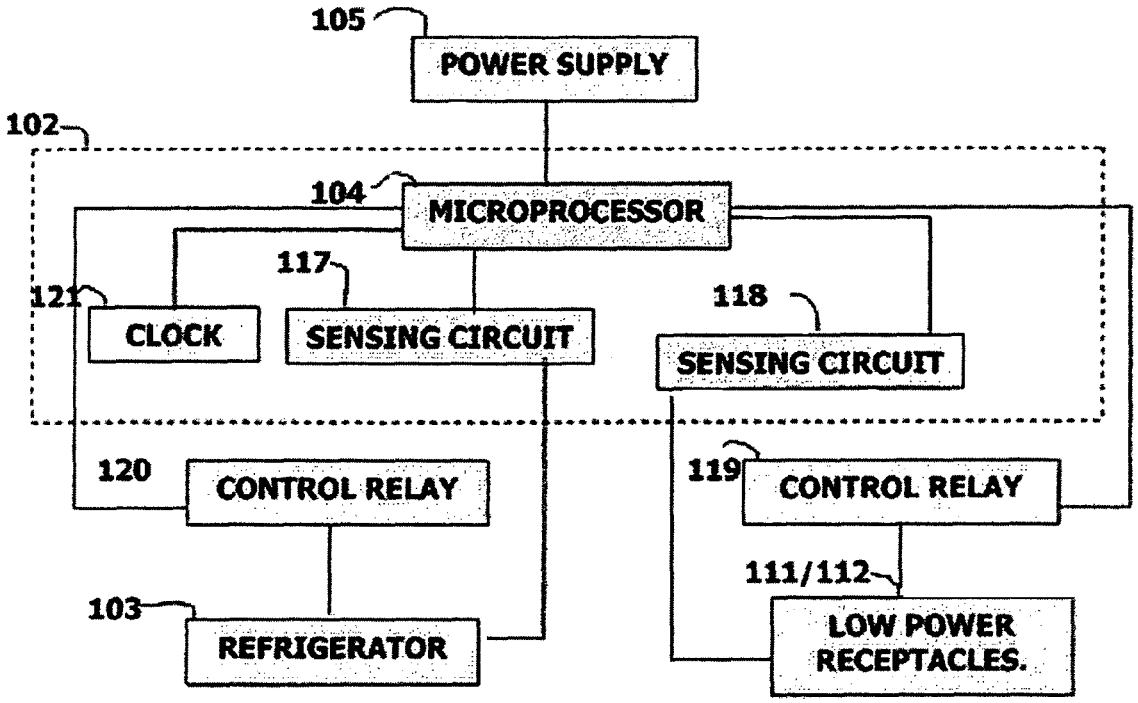
FIG. 9 is a block diagram of an alternate embodiment of this application.
Figure 10:
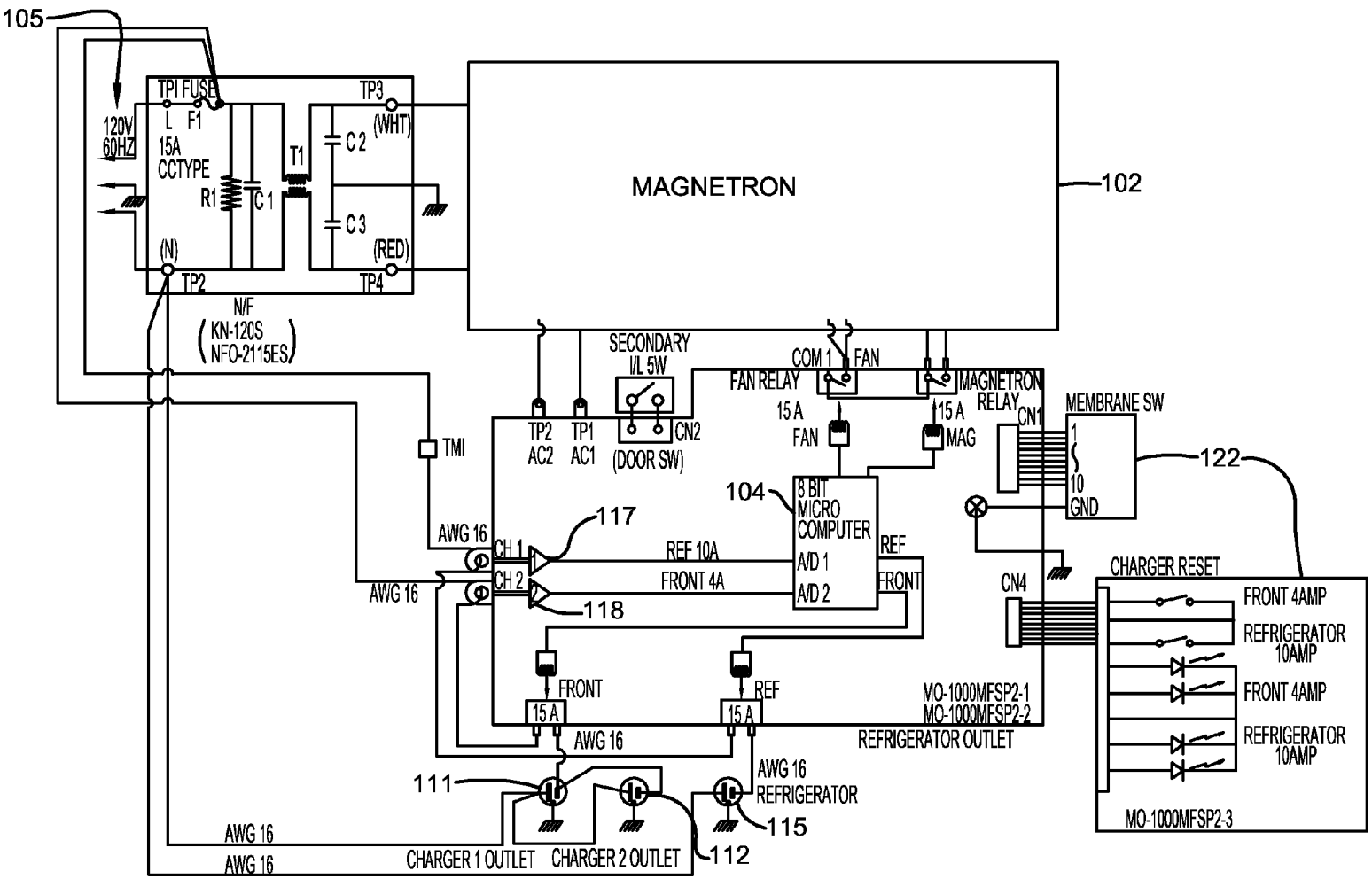
FIG. 10 is a schematic diagram of the embodiment of FIG. 9.
Figure 11:
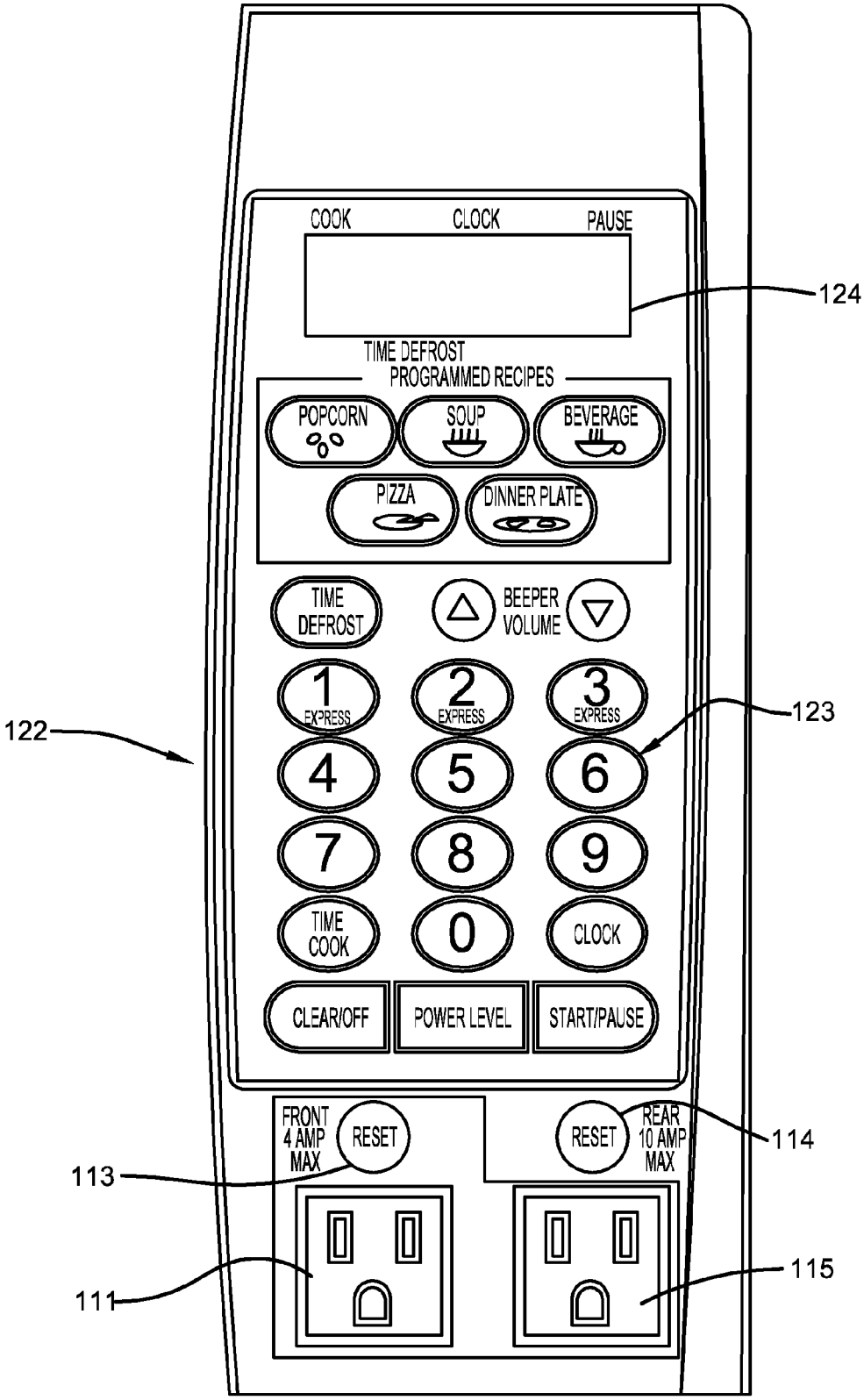
FIG. 11 is an illustration of a control panel of the embodiment of FIG. 9.

FIGS. 9-11 illustrate another embodiment. In this embodiment the sensing components 117 and 118 are connected to reduce the risk of overload by the combined demands of the auxiliary outlets 111 and 112 and the refrigerator outlet 115. In the configuration, as shown in FIG. 10, current sensor 117 is connected to monitor the current in the refrigerator outlet 115 and is constructed to limit the refrigerator current component so that it does not exceed 10 amps. Current sensor 118 is connected to monitor the combined current in the auxiliary outlets 111 and 112. Current sensor 118 is constructed to limit the combined auxiliary outlet current to 4 amps. In this manner the risk of overload is minimized. In the block diagram of FIG. 9, the microwave 102 having controller 104 is connected to power supply 105. Clock 121 provides a timing device to generate a restart delay for refrigerator 103. Sensing circuit/sensor 117 is connected to monitor the current demanded by refrigerator 103 and sensing circuit/sensor 118 is connected to low power receptacles 111 and 112 to monitor the combined current in receptacle 111 and 112.

In this embodiment, as shown in FIG. 11, a control panel 122 is arranged with a keypad 123 for manual control and a display 124. Auxiliary outlet 111 is shown as accessible from the front and is associated with a status LED indicator and reset button 113 that may be caused to be on during use and switch to a flashing mode when the microwave is running. Refrigerator outlet 115 is also shown to be accessible from the front panel and is associated with an LED indicator and reset button 114. Similarly LED indicator 114 is controlled to be on during use of the refrigerator and to switch to a flashing mode when the microwave is operating.

A further embodiment of the processor operational model is shown in FIG. 6. In this model, the refrigerator demands power. This may be triggered by a temperature drop in the refrigerator and involve start up of the refrigerator compressor with an associated peak power demand. If the microwave is on, the recycling of the refrigerator will be delayed. If the microwave was on and subsequently cycled off, the clock 21 must be checked to determine if the restart can occur. Under some circumstances, it may be necessary to give the refrigerator priority to prevent an undesirable drop in temperature. In the latter instance, microcontroller can be coupled to the refrigerator temperature sensor to execute a time sequence during which the microwave will be disabled to allow the refrigerator to return to proper operating temperatures.

In the embodiment of FIG. 7, priority is given to the power demands of the microwave oven, as indicated above. Use of the receptacles 11, 12, and 15 are, therefore, disabled during microwave operation. The operational models, illustrated in FIGS. 5-7, may be established by algorithms that are programmed or imbedded in controller 4.

In this manner a system of linked appliances, including a microwave oven, refrigerator, and a low power appliance may all be connected through a common supply cord without the risk of inconvenient interruptions in use caused by overloads.

It should be understood that the above description is only illustrative of the invention. Various alternatives and modifications can be devised by those skilled in the art with out departing from the invention. Accordingly, the present invention is intended to embrace all such alternatives, modifications and variances which fall with the scope of the appended claims.

I claim:

1. A system of linked appliances comprising:

a microwave oven connected to a source of power and having a control processor for controlling the operation of the microwave oven;

a first power supply outlet provided on the microwave oven;

a refrigerator connected to the source of power by connection to the first power supply outlet;

a second power supply outlet connected to the source of power through the control processor, the second power supply outlet adapted to receive an appliance having lower power requirements than power requirements of the refrigerator;

sensing components connected to sense current demanded at the second power supply outlet, and generating signals indicative thereof;

wherein the control processor is configured to enable or disable power to the microwave oven, the first power supply outlet and the second power supply outlet, according to an algorithm in the control processor, and wherein the algorithm causes the control processor to:

disable the refrigerator and the second power supply outlet, when the microwave oven demands power; and enable the second power supply outlet when the microwave oven is off; and wherein the microwave oven includes a front portion, wherein the front portion includes a door and a front control panel, wherein the front control panel includes the first and second power supply outlets.

2. The system according to claim 1 wherein the control processor further disables the second power supply outlet when the sensing components signals indicate current in excess of a predetermined limit.

3. The system according to claim 2, wherein the predetermined current limit is two amps.

4. The system according to claim 2 further comprising a reset button, wherein the reset button is operatively associated with the second power supply outlet.

5. The system according to claim 2 further comprising a reset button, wherein the reset button is operatively associated with the second power supply outlet, wherein the reset button is configured to enable the second power supply outlet upon actuation of the reset button and when the sensing components sense current demanded at the second power supply outlet to be not in excess of the predetermined limit.

6. The system according to claim 5 further comprising an indicator, wherein the indicator is operatively associated with the second power supply outlet, wherein the indicator is configured to be in a first state to indicate that the second power supply outlet is enabled, wherein the indicator is configured to be in a second state to indicate that the second power supply outlet is disabled.

7. The system according to claim 6 wherein the indicator comprises a lamp, wherein the lamp is configured to light when the second power supply outlet is enabled.

8. The system according to claim 2 wherein the front control panel includes a combination indicator and reset button, wherein the combination indicator and reset button is operatively associated with the second power supply outlet, wherein the combination indicator and reset button is configured to be in a first state to indicate that the second power supply outlet is enabled, wherein the combination indicator and reset button is configured to be in a second state to indicate that the second power supply outlet is disabled.

9. The system according to claim 2 wherein the control processor is configured to be coupled to a refrigerator temperature sensor, wherein the control processor is configured to disable the microwave in response to a predetermined temperature drop in the refrigerator sensed by the temperature sensor.

10. The system according to claim 1, wherein the control processor starts a clock when the refrigerator is disabled and prevents the subsequent enabling of the refrigerator before the expiration of a predetermined time limit.

11. The system according to claim 10, wherein the predetermined time period is three minutes.

12. The system according to claim 1, wherein the second power supply outlet further comprises at least two auxiliary outlets to provide power to charge battery operated electronic devices and the sensing components are connected to sense the current demanded at each of the auxiliary outlets.

13. The system according to claim 1, wherein the sensing components further comprise a first current sensor connected to monitor the current in the first power supply outlet and a second current sensor to monitor the current in the second power supply outlet and wherein the control processor, in response to the first and second current sensors is configured to limit the combined current in the first and second power supply outlets to a predetermined value.

14. The system according to claim 13 wherein the predetermined value is less than 15 amps.

15. The system according to claim 1, wherein the second power supply outlet further comprises at least two auxiliary outlets to provide power to charge battery operated electronic devices; and wherein the sensing components further comprise a first current sensor connected to monitor the current in the first power supply outlet and a second current sensor to monitor the combined circuit current in the at least two auxiliary outlets and wherein the control processor, in response to the first and second current sensors is configured to limit the combined current in the first and second power supply outlets to a predetermined value.

16. The system according to claim 15 wherein the predetermined value is less than 15 amps.

17. The system according to claim 15, wherein the predetermined value is less than 4 amps.

18. The system according to claim 1 wherein the control processor is configured to disable the second power supply outlet when the refrigerator is operated during compressor startup.

19. The system according to claim 1 wherein the appliance is one of a lap top computer, a cellular phone, a PDA, a personal media device, and a digital camera.

20. A non-transitory processor storage readable medium having processor readable program code embodied therein for operating a control processor to control a system of multiple linked appliances having a microwave oven, a refrigerator, and an auxiliary power supply outlet, wherein the processor readable program code causes the control processor to: disable the refrigerator and the auxiliary power supply outlet, when the microwave oven demands power; and enable the auxiliary power supply outlet when the microwave oven is off, wherein the microwave oven includes a combination indicator and reset button, wherein the combination indicator and reset button is operatively associated with the auxiliary power supply outlet, wherein the combination indicator and reset button is configured to be in a first state to indicate that the auxiliary power supply outlet is enabled, wherein the combination indicator and reset button is configured to be in a second state to indicate that the auxiliary power supply outlet is disabled.

21. The non-transitory processor storage readable medium, according to claim 20 wherein the processor readable program code further causes the control processor to disable the auxiliary power supply outlet when sensing components indicate that current at the auxiliary power supply outlet is in excess of a predetermined limit.

22. The non-transitory processor storage readable medium, according to claim 21, wherein the microwave oven includes a front portion, wherein the front portion includes a door and a front control panel, wherein the front control panel includes the auxiliary power supply outlet and the combination indicator and reset button.

23. The non-transitory processor storage readable medium, according to claim 21 wherein the combination indicator and reset button is configured to enable the auxiliary power supply outlet upon actuation of the combination indicator and reset button and when the sensing components sense current at the auxiliary power supply outlet to be not in excess of the predetermined limit.

24. The non-transitory processor storage readable medium, according to claim 20, wherein the processor readable program code causes the control processor to start a clock when the refrigerator is disabled and further to prevent the subsequent enabling of the refrigerator before the expiration of a predetermined time limit.

25. The non-transitory processor storage readable medium, according to claim 20 wherein the combination indicator and reset button comprises a lamp, wherein the lamp is configured to light when the auxiliary power supply outlet is enabled.

26. The system according to claim 1 further comprising an indicator, wherein the indicator is operatively associated with the second power supply outlet, wherein the indicator is configured to be in a first state to indicate that the second power supply outlet is being used by the appliance.

27. The system according to claim 26, wherein the indicator is configured to be in a second state to indicate that the microwave oven is operating.

28. A system of linked appliances comprising:

a microwave oven connected to a source of power;

a refrigerator connected to the source of power;

an auxiliary power supply outlet connected to the source of power, wherein the auxiliary power supply outlet is located at a front portion of the microwave oven;

a control processor operatively associated with the microwave oven, the refrigerator, and the auxiliary power supply outlet, wherein the control processor is configured to enable or disable power to the microwave oven, the refrigerator, and the auxiliary power supply outlet according to an algorithm in the control processor, and wherein the algorithm causes the control processor to:

disable the refrigerator and the auxiliary power supply outlet, when the microwave oven demands power; and enable the auxiliary power supply outlet when the microwave oven is off; and an indicator, wherein the indicator is operatively associated with the auxiliary power supply outlet, wherein the indicator is configured to be in a first state to indicate that the auxiliary power supply outlet is being used by the appliance, wherein the indicator is configured to be in a second state to indicate that the microwave oven is operating.

29. The system according to claim 28, wherein the control processor is configured to disable the auxiliary power supply outlet when the refrigerator is operated during compressor startup.

30. The system according to claim 28, wherein the indicator comprises a lamp, wherein the lamp is configured to flash when the indicator is in the second state.

31. The system according to claim 30, wherein the lamp is configured to light when the indicator is in the first state.

* * * * *